US007175237B2

(12) United States Patent
Neuper et al.

(10) Patent No.: US 7,175,237 B2
(45) Date of Patent: Feb. 13, 2007

(54) HEWING OR CUTTING ROLL

(75) Inventors: Reinhard Neuper, Judenburg (AT); Ralf Grief, Zeltweg (AT)

(73) Assignee: Voest-Alpine Bergtechnik Gesellschaft m.b.H., Zeltweg (AT)

( * ) Notice: Subject to any disclaimer, the term of this patent is extended or adjusted under 35 U.S.C. 154(b) by 0 days.

(21) Appl. No.: 11/125,794

(22) Filed: May 10, 2005

(65) Prior Publication Data

US 2005/0248209 A1 Nov. 10, 2005

(30) Foreign Application Priority Data

May 10, 2004 (AT) ..... GM342/2004

(51) Int. Cl.
*E21C 25/10* (2006.01)

(52) U.S. Cl. ..... 299/80.1

(58) Field of Classification Search ..... 299/80.1
See application file for complete search history.

(56) References Cited

U.S. PATENT DOCUMENTS 2,801,094 A * 7/1957 Ball ..... 299/80.1
2,919,150 A * 12/1959 Baker ..... 403/27
3,617,093 A * 11/1971 Daily ..... 299/80.1
3,844,618 A * 10/1974 Delli-Gatti, Jr. ..... 299/64
4,489,985 A * 12/1984 Kendrick ..... 299/80.1
5,163,769 A * 11/1992 Dresselhouse ..... 403/27

* cited by examiner

*Primary Examiner*—John Kreck
(74) *Attorney, Agent, or Firm*—Chapman and Cutler LLP

(57) ABSTRACT

In a hewing or cutting roll including a central roll part and at least one lateral roll part telescopically extractable in the axial direction of the roll, wherein the central roll part and the extractable roll part have each a connection site for a hydraulic cylinder piston unit, the hydraulic cylinder piston unit is arranged to be pivotable relative to the central roll part and/or the extractable roll part about at least two axes and, in particular, universally.

14 Claims, 3 Drawing Sheets

HEWING OR CUTTING ROLL

BACKGROUND OF THE INVENTION

1. Field of the Invention

The invention relates to a hewing or cutting roll including a central roll part and at least one lateral roll part telescopically extractable in the axial direction of the roll, wherein the central roll part and the extractable roll part have each a connection site for a hydraulic cylinder piston unit.

2. Prior Art

In order to enlarge the cutting width of cutting rolls, it has already been known to provide roll sections telescopically displaceable in the axial direction, which are arranged to be displaceable in the direction of the axis of rotation of the cutting roller and fixable in their respective position.

From U.S. Pat. No. 3,730,593, a hewing machine can be taken, in which lateral roll parts are designed to be displaceable relative to a central roll part in order to adapt the cutting width to the respective requirements. To this end, that configuration comprises a plurality of complex slide guides provided in the region of the cutting roll as well as in the region of the bearing and mounting points of the cutter arm. Telescopically extractable and retractable roll parts of that type require relatively complex drives, and the mounting of the telescopically extractable parts must be realized in a manner so as to allow for their axial displaceability on the one hand, and safeguard the rotationally fast connection with the remaining parts of the roll on the other hand. On account of the required axial displaceability, the rotationally fast connection must exhibit some play, whereby such driving connections are exposed to high wear. A change in the cutting width serves in the first place to enhance the maneuverability of the entire machine and is aimed to avoid impediments by already set walling props or the like when passing narrow curves or narrow track sections.

Known devices of the initially defined kind, in which roll parts are mounted so as to be displaceable in the direction of the axis of rotation of the hewing or cutting roll and connected in a rotationally fast manner with the non-displaceably mounted part, may, for instance, be taken from U.S. Pat. No. 3,614,162. In that device, a cylinder piston unit is provided for extracting the displaceable roll part, whose cylinder is rigidly arranged within the driving shaft for the rotary drive of the cutting rolls and whose piston rod is connected with the extractable roll part. Furthermore, an extractable cutting drum has become known from U.S. Pat. No. 3,695,725, wherein the two concentric drum parts of the extractable roll part embrace the drum of the central roll part. The fixation of the cylinder piston unit for the axial drive of the extractable roll part is realized in a manner similar to that of the configuration according to U.S. Pat. No. 3,614,162.

The known configurations involve the disadvantage of some play occurring between the extractable and the central roll parts on account of the complex mounting of the extractable roll part, which has to allow for the axial displaceability on the one hand, and to ensure the rotationally fast connection with the central roll part on the other hand. That play, which is even further increased by the wear occurring during the operation of the hewing or cutting roll, may possibly cause tilting of the extractable roll part relative to the central roll part and, as a result, even canting of the cylinder piston unit, thus leading to an impairment of the axial displacement drive of the extractable roll part.

SUMMARY OF THE INVENTION

The invention aims to provide a simple and operationally safe construction by which canting of the cylinder piston unit will be prevented and the operating safety of the cutting roll will be safeguarded even in the case of worn mounting and guiding elements.

To solve this object, the configuration according to the invention consists essentially in that the hydraulic cylinder piston unit is arranged to be pivotable relative to the central roll part and/or the extractable roll part about at least two axes and, in particular, universally. The pivotal mounting of the cylinder piston unit ensures that the cylinder piston unit will exclusively take up axial forces and not be stressed by tilting moments. By the configuration according to the invention, tilting moments caused by the eccentric exertion of force on the hewing or cutting rolls and, in particular, on the extractable roll part will be absorbed in the respective pivot bearings by which the hydraulic cylinder piston unit is articulated to the connection sites of the central roll part and the extractable roll part, respectively. By connection sites, those geometric locations are denoted, on which the hydraulic cylinder piston unit is linked or connected to the central and extractable roll parts. The articulated connection of the hydraulic cylinder piston unit in this case is realized according to the invention in a manner that an at least biaxial pivotability is enabled. A universal pivotability can, for instance, be reached by a cardanic coupling or by a ball-shaped, spherical or cambered design of the respective contact surfaces of the bearing parts.

In a preferred manner, the configuration in this respect is further developed in that the hydraulic cylinder piston unit has a spherical or ball-shaped outer surface on its end facing the connection site of the central roll part and/or the connection site of the extractable roll part, which end is mounted in a ball socket connected with the connection site. Since the admissible eccentric displacement of the parts of the pivot arm relative to one another is limited by the admissible maximum wear, it will also do to delimit the pivot angle of the hydraulic cylinder piston unit in that the end face of the spherical or ball-shaped end of the hydraulic cylinder piston unit is designed to be flattened and is arranged in a spaced-apart relationship to the counter surface of the ball socket, facing the same. The respectively admissible maximum pivot angle of the hydraulic cylinder piston unit in this case is determined, and accordingly released, by the selection of the distance between the flattened end of the cylinder piston unit and the respective counter surface of the ball socket.

In order to transmit the forces then acting exclusively axially on the cylinder piston unit due to the configuration according to the invention and, vice versa, to effectively transmit the adjustment forces of the cylinder piston unit on the extractable roll part, it is provided according to a preferred embodiment that the end facing the connection site of the extractable roll part, of the piston rod of the hydraulic cylinder piston unit carries an annular groove engaged by an engaging piece coupled with the extractable roll part. In this case, the engaging piece, which is preferably designed as a divided plate, is aimed to allow for a pivotability of the cylinder piston unit relative to the extractable roll part within defined limits. The configuration in addition may, therefore, preferably be further developed such that the end face of the hydraulic cylinder piston unit, that faces the connection site of the extractable roll part is overlapped by a connection plate, wherein the end face of the cylinder piston unit and/or the counter surface of the connection plate cooperating therewith are designed to be cambered.

In order to enable the central transmission of force, it is preferably provided that the connection site of the extractable roll part is formed on an annular connection part arranged in the interior of the drum carrying the hewing or cutting tools. Thereby, a free space is advantageously provided between the inner connection ring arranged concentrically with the outer drum, and the drum, in which free space suitable cutting tools may be arranged in a space-saving manner. To this end, the configuration is preferably devised such that at least one pick fastened to the connection part is arranged in the annular space formed between the inner circumference of the extractable drum and the outer circumference of the annular connection part, the tip of said pick projecting out of the annular space. Additional cutting tools may be directly arranged on the end side of the extractable roll part, to which end the configuration is preferably further developed such that the connection plate carries cutting tools, preferably core cutters.

The advantageous arrangement of a connection ring may also be envisaged on the hydraulic cylinder piston unit side facing the central roll part, and the configuration is, therefore, preferably further developed such that the central roll part comprises a drum carrying cutting or hewing tools, and that the connection site of the central roll part is formed on an annular connection part arranged in the interior of the drum, which connection part is connected in a rotationally fast manner both with the driving shaft of the rotary drive for the hewing or cutting roll and with the drum. The central connection ring in this case serves for the articulate connection of the cylinder piston unit and, at the same time, as a rotationally fast connection between the driving shaft and the outer drum carrying the cutting or hewing tools. The drive of the central roll part is, thus, directly derived from the driving shaft, while the rotary drive of the extractable roll part is realized in that the extractable roll part is connected with the central roll part in a rotationally fast manner. A preferred configuration in this respect is devised such that the extractable roll part is guided within the central roll part so as to be displaceable in the axial direction and is connected in a rotationally fast manner with the central roll part by the aid of feather keys.

In order to finally ensure the supply of the hydraulic cylinder piston unit with an appropriate hydraulic fluid, it is provided according to a preferred embodiment that a rotary leadthrough for the hydraulic lines connected to the hydraulic cylinder piston unit is provided between the connection site of the central roll part and the cylinder piston unit. Said leadthrough makes sure that the hydraulic fluid fed through the hydraulic lines arranged in a protected manner, for instance, in the interior of the driving shaft will be apportioned to the supply lines rotating along with the hydraulic cylinder piston unit.

BRIEF DESCRIPTION OF THE DRAWINGS

In the following, the invention will be explained in more detail by way of an exemplary embodiment schematically illustrated in the drawing.

DESCRIPTION OF THE PREFERRED EMBODIMENTS

Figure 1:
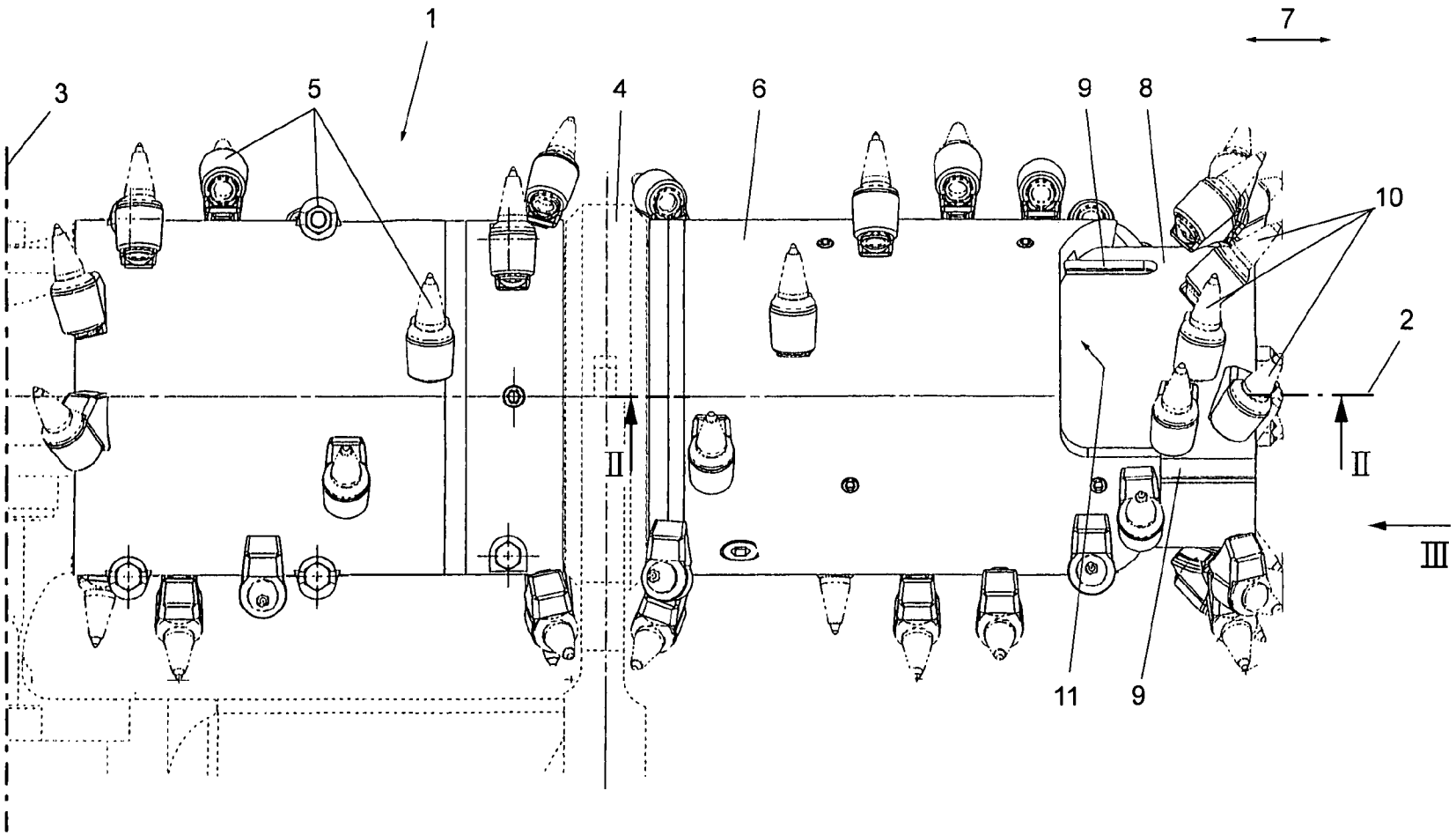
FIG. 1 is a top view on the cutting or hewing roll according to the invention.

FIG. 1 depicts one half of a hewing or cutting roll 1, which is driven to rotate about an axis 2 on a cutter arm not illustrated in detail. The center of the gear is denoted by 3. The cutting roll 1 is mounted in a bearing 4 of the cutter arm and carries hewing or cutting tools 5. In accordance with the invention, the hewing or cutting roll 1 comprises a central roll part 6 and a lateral roll part 8 which is telescopically extractable in the axial direction of the roll, in the sense of double arrow 7. The extractable roll part 8 in this case is connected in a rotationally fast manner with the central roll part 6 by means of feather keys 9. The extractable roll part 8 carries separate hewing or cutting tools 10, whereby the central roll part 6 includes recesses 11 in which the cutting tools 10 come to lie in the retracted position of the extractable roll part 8. By such a comb-like design of the central roll part 6, optimum space utilization and ideal pick setting both in the extracted and in the retracted positions of the extractable roll part 8 are feasible.

Figure 2:
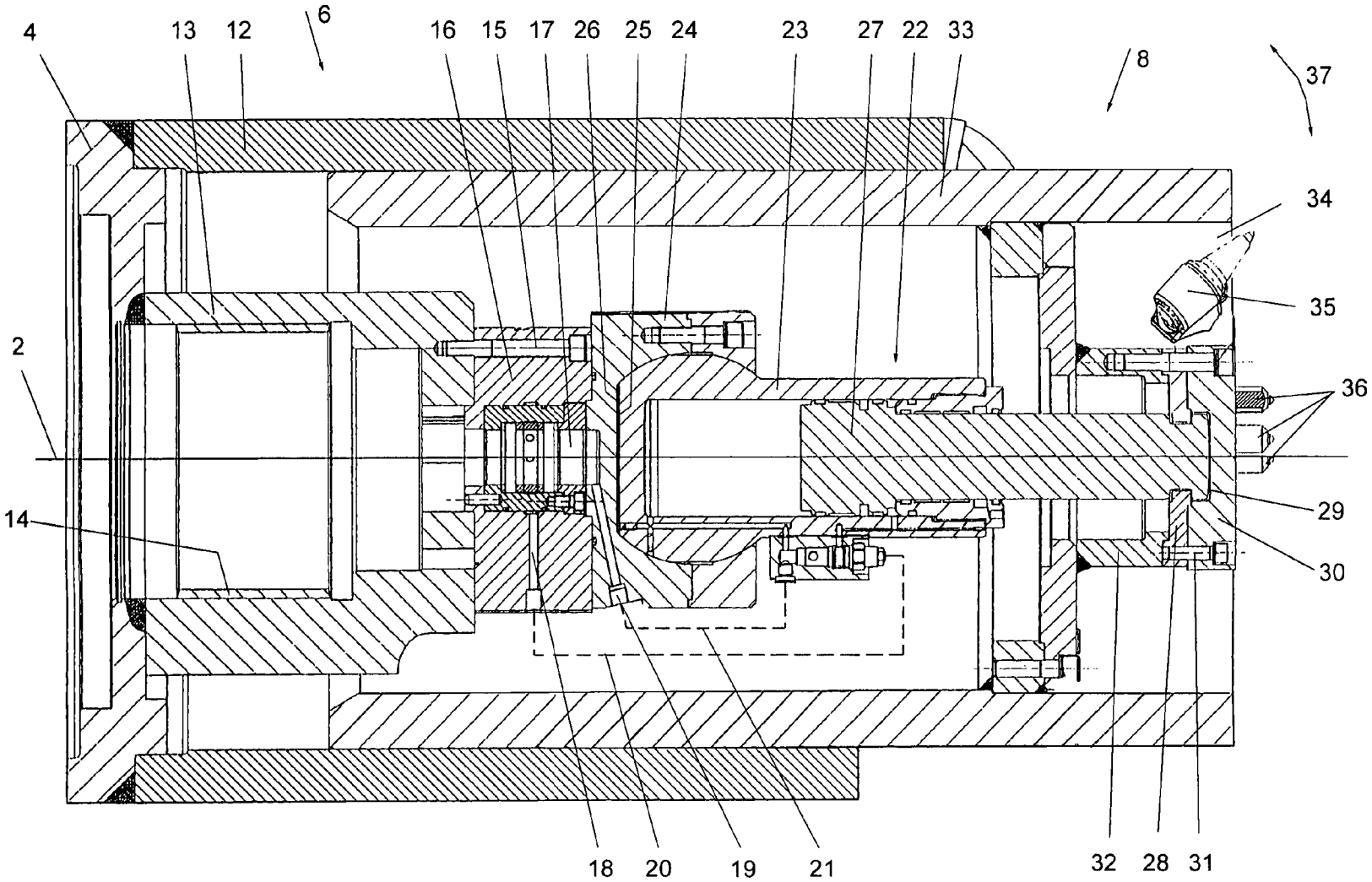
FIG. 2 is a section along line ll—ll of FIG. 1.

From the sectional illustration according to FIG. 2, it is apparent that in the interior of the drum 12 of the central roll part 6 an annular connection part 13 connected therewith in a rotationally fast manner is arranged, which is set in rotation by a driving shaft not illustrated in detail, via a pinion 14. The supply of a hydraulic medium to a rotary leadthrough 16 connected with the connection part 13 in a rotationally fast manner by a screwing fixation 15 takes place in the interior of the shaft, whereby the stationary, inner part 17 of the rotary leadthrough comprises two chambers each fed by a hydraulic line and each being in fluid-connection with discharge lines 18 and 19, respectively, arranged in the rotating parts. Consequently, the hydraulic medium is fed via lines 20 and 21 to a cylinder piston unit 22 by which the extractable roll part 8 is driven in the sense of double arrow 7. The cylinder 23 of the hydraulic cylinder piston unit 22 in this case is designed to have on its end a spherical or ball-shaped surface, which is mounted in a ball socket 24 so as to enable a universal pivotal movement of the hydraulic cylinder piston unit 22. The pivot angle is thereby limited by the play formed between the flattened end side 25 of the cylinder 23 and the respective counter surface 26 of the ball socket 24. On its end, the piston, or piston rod 27, of the hydraulic cylinder piston unit 22 is connected in the axial direction with the extractable roll part 8 in a positive and force-transmitting manner via an engaging piece plate 28. In order to also enable a pivotal movement in the region of this connection site of the piston 27 to the extractable roll part 8, the end face 29 of the piston 27 is designed to be cambered, resting on a counter surface of a connection plate 30. The connection plate 30 is, in turn, connected with the engaging piece 28 and an annular connection part 32 via a screwing fixation 31, the connection part 32 being connected with the drum 33 of the extractable roll part 8 in a rotationally fast manner.

In the hollow space 34 remaining between the drum 33 and the annular connection part, schematically indicated cutting tools 35 may be arranged. The connection plate 30 may, moreover, carry core cutters 36.

The radial play formed between the central roll part 6 and the extractable roll part 8, which may even increase due to wear, may cause tilting movements of the extractable roll part 8 in the sense of arrow 37 during operation. Such tilting movements must, however, not be further transmitted to the cylinder piston unit 22, since this would cause the piston 27 to cant within the cylinder 23. The articulate mounting of the cylinder piston unit 22 according to the invention serves to prevent such canting.

Figure 3:
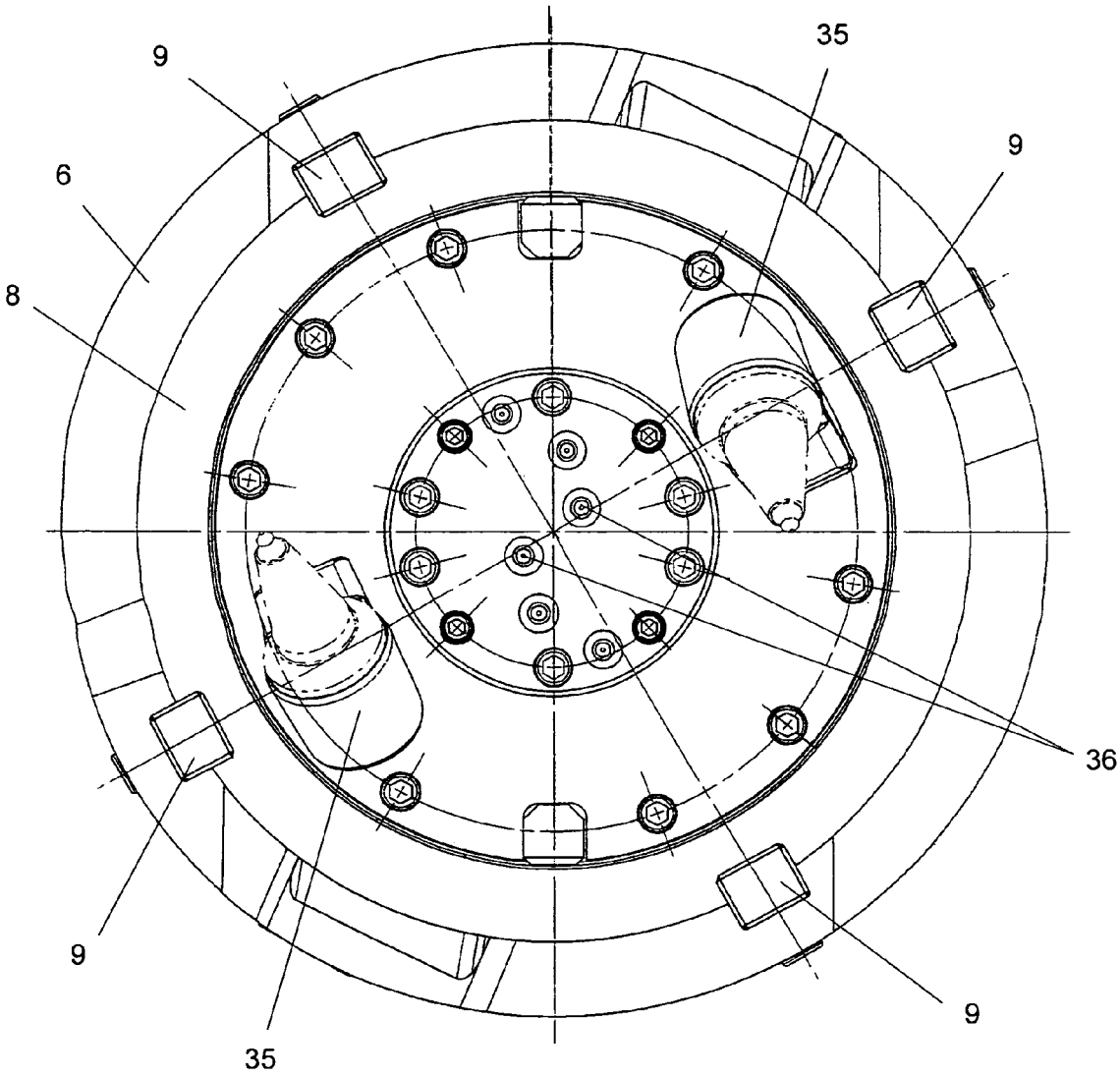
FIG. 3 is a view in the sense of arrow 3 of FIG. 1.

In the illustration according to FIG. 3, the feather keys 9, cutting tools 35 and core cutters 36 are visible. Such an arrangement of the cutting tools on the end face of the extractable roll part 8 enables optimum pick setting, thus enhancing the cutting performance even in the lateral region of the cutting roll.

We claim:

1. A hewing or cutting roll (1), comprising:

a central roll part (6); and at least one lateral roll part (8) telescopically extractable in the axial direction (7) of the roll (1), wherein the central roll part (6) and the extractable roll part (8) each comprise a connection site for a hydraulic cylinder piston unit (22), wherein the hydraulic cylinder piston unit (22) comprises a piston guided within a cylinder bore surrounded by a cylinder wall of a cylinder and is arranged to be pivotable relative to at least one of the central roll part (6) and the extractable roll part (8) about at least two axes, and wherein the cylinder wall of the hydraulic cylinder piston unit (22) comprises a spherical or ball-shaped outer surface on an end of said hydraulic cylinder piston unit (22) facing at least one of the connection site of the central roll part (6) and the connection site of the extractable roll part (8), which end is mounted in a ball socket (24) connected with said connection site.

2. A hewing or cutting roll according to claim 1, wherein an end face (25) of the spherical or ball-shaped outer surface of the end of the hydraulic cylinder piston unit (22) is designed to be flattened and is arranged in a spaced-apart relationship with respect to a counter surface (26) of the ball socket (24), facing the ball socket (24).

3. A hewing or cutting roll according to claim 2, wherein an end of a piston rod (27) of the hydraulic cylinder piston unit (22) facing the connection site of the extractable roll part (8) comprises an annular groove engaged by an engaging piece (28) coupled with the extractable roll part (8).

4. A hewing or cutting roll according to claim 1, wherein an end of a piston rod (27) of the hydraulic cylinder piston unit (22) facing the connection site of the extractable roll part (8) comprises an annular groove engaged by an engaging piece (28) coupled with the extractable roll part (8).

5. A hewing or cutting roll according to claim 1, wherein the extractable roll part (8) comprises a drum (33) provided with hewing or cutting tools.

6. A hewing or cutting roll according to claim 5, wherein the connection site of the extractable part (8) is formed on an annular connection part (32) arranged in an interior of the drum (33).

7. A hewing or cutting roll according to claim 6, wherein at least one pick (35) fastened to the connection part (32) is arranged in an annular space (34) formed between an inner circumference of the extractable drum (33) and an outer circumference of the annular connection part (32), a tip of said pick projecting out of the annular space (34).

8. A hewing or cutting roll according to claim 7, wherein an end face (29) of the hydraulic cylinder piston unit (22) that faces the connection part (32) of the extractable roll part (8) is overlapped by a connection plate (30), and wherein at least one of the end face (29) of the cylinder piston unit (22) and a counter surface of the connection plate cooperating therewith are designed to be cambered.

9. A hewing or cutting roll according to claim 6, wherein an end face (29) of the hydraulic cylinder piston unit (22) that faces the connection part (32) of the extractable roll part (8) is overlapped by a connection plate (30), and wherein at least one of the end face (29) of the cylinder piston unit (22) and a counter surface of the connection plate cooperating therewith are designed to be cambered.

10. A hewing or cutting roll according to claim 9, wherein the connection plate (30) carries cutting tools.

11. A hewing or cutting roll according to claim 1, wherein the central roll part (6) comprises a drum (12) carrying cutting or hewing tools (5), and the connection site of the central roll part (6) is formed on an annular connection part (13) arranged in an interior of the drum (12), which connection part (13) is connected in a rotationally fast manner with a driving shaft of a rotary drive for the hewing or cutting roll (1) and with the drum (12).

12. A hewing or cutting roll according to claim 1, wherein the extractable roll part (8) is guided within the central roll part (6) so as to be displaceable in the axial direction (7) and is connected in a rotationally fast manner with the central roll part (6) by the aid of feather keys (9).

13. A hewing or cutting roll according to claim 1, wherein a rotary leadthrough (16) for hydraulic lines (20, 21) connected to the hydraulic cylinder piston unit (22) is provided between the connection site of the central roll part (6) and the cylinder piston unit (22).

14. A hewing or cutting roll (1), comprising:

a central roll part (6); and at least one lateral roll part (8) telescopically extractable in the axial direction (7) of the roll (1), wherein the central roll part (6) and the extractable roll part (8) each comprise a connection site for a hydraulic cylinder piston unit (22), wherein the hydraulic cylinder piston unit (22) comprises a piston guided within a cylinder bore surrounded by a cylinder wall of a cylinder and is arranged to be universally pivotable relative to at least one of the central roll part (6) and the extractable roll part (8), and wherein the cylinder wall of the hydraulic cylinder piston unit (22) comprises a spherical or ball-shaped outer surface on an end of said hydraulic cylinder piston unit (22) facing at least one of the connection site of the central roll part (6) and the connection site of the extractable roll part (8), which end is mounted in a ball socket (24) connected with said connection site.

* * * * *